US006763911B2

(12) United States Patent
Burch

(10) Patent No.: US 6,763,911 B2
(45) Date of Patent: Jul. 20, 2004

(54) EMERGENCY EVACUATION SYSTEM FOR A STAIRCASE

(76) Inventor: Leon A. Burch, 11 Christy La., Naugatuck, CT (US) 06770

( * ) Notice: Subject to any disclaimer, the term of this patent is extended or adjusted under 35 U.S.C. 154(b) by 0 days.

(21) Appl. No.: 10/178,018

(22) Filed: Jun. 20, 2002

(65) Prior Publication Data

US 2003/0234139 A1 Dec. 25, 2003

(51) Int. Cl.[7] ..... A62B 1/20
(52) U.S. Cl. ..... 182/49
(58) Field of Search ..... 182/48, 49; 14/71.1

(56) References Cited

U.S. PATENT DOCUMENTS 3,621,383 A * 11/1971 Rush et al. ..... 324/414
3,743,281 A * 7/1973 Gimbel ..... 472/116
3,756,440 A * 9/1973 Raap et al. ..... 414/537
3,840,922 A * 10/1974 Morrison et al. ..... 482/15
4,037,685 A 7/1977 Talucci
4,167,224 A 9/1979 Kinase et al.
4,240,520 A 12/1980 LaGrone et al.
4,650,034 A * 3/1987 D'Avanzo ..... 182/49
4,813,663 A * 3/1989 Rice ..... 472/116
5,025,891 A 6/1991 Naka et al.
5,150,765 A 9/1992 Chen
5,150,767 A * 9/1992 Miller ..... 182/137
5,203,427 A * 4/1993 Williams et al. ..... 182/129
5,209,323 A 5/1993 Hopkins
5,427,574 A * 6/1995 Donnelly-Weide ..... 472/116
5,535,848 A * 7/1996 Giuliano et al. ..... 182/49
5,620,058 A 4/1997 Forrester
6,550,967 B2 * 4/2003 Hedaya ..... 383/127

* cited by examiner

*Primary Examiner*—Alvin Chin-Shue
(74) *Attorney, Agent, or Firm*—Scott D. Wofsy; Edwards & Angell, LLP

(57) ABSTRACT

An emergency evacuation slide is disclosed defined by an elongated base portion configured for deployment in a staircase having a flight of stairs including a plurality of horizontal treads, the base portion having an inner lateral edge configured for attachment to a side wall of the staircase and an outer lateral edge extending into the staircase, the evacuation slide adapted for movement from a stowed position in which the base portion is parallel to the side wall of the staircase to a deployed position in which the base portion is perpendicular to the side wall of the staircase and disposed in a plane extending tangent to the treads of the stairs.

28 Claims, 5 Drawing Sheets

FIG. 8
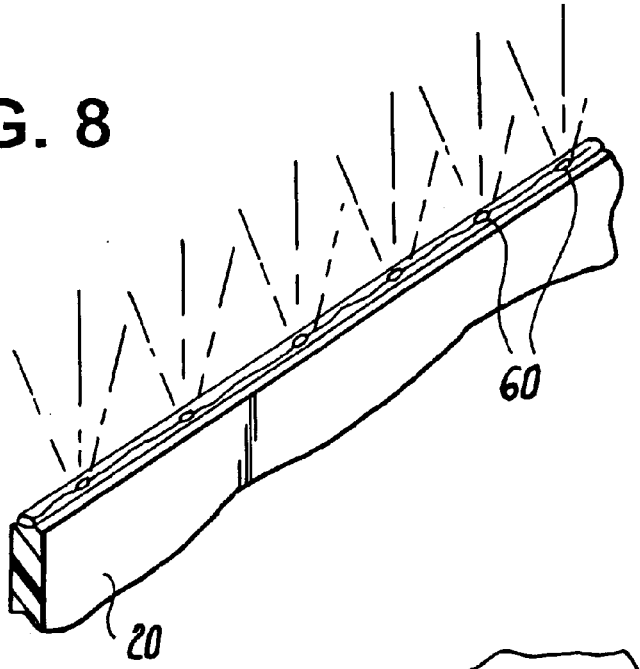
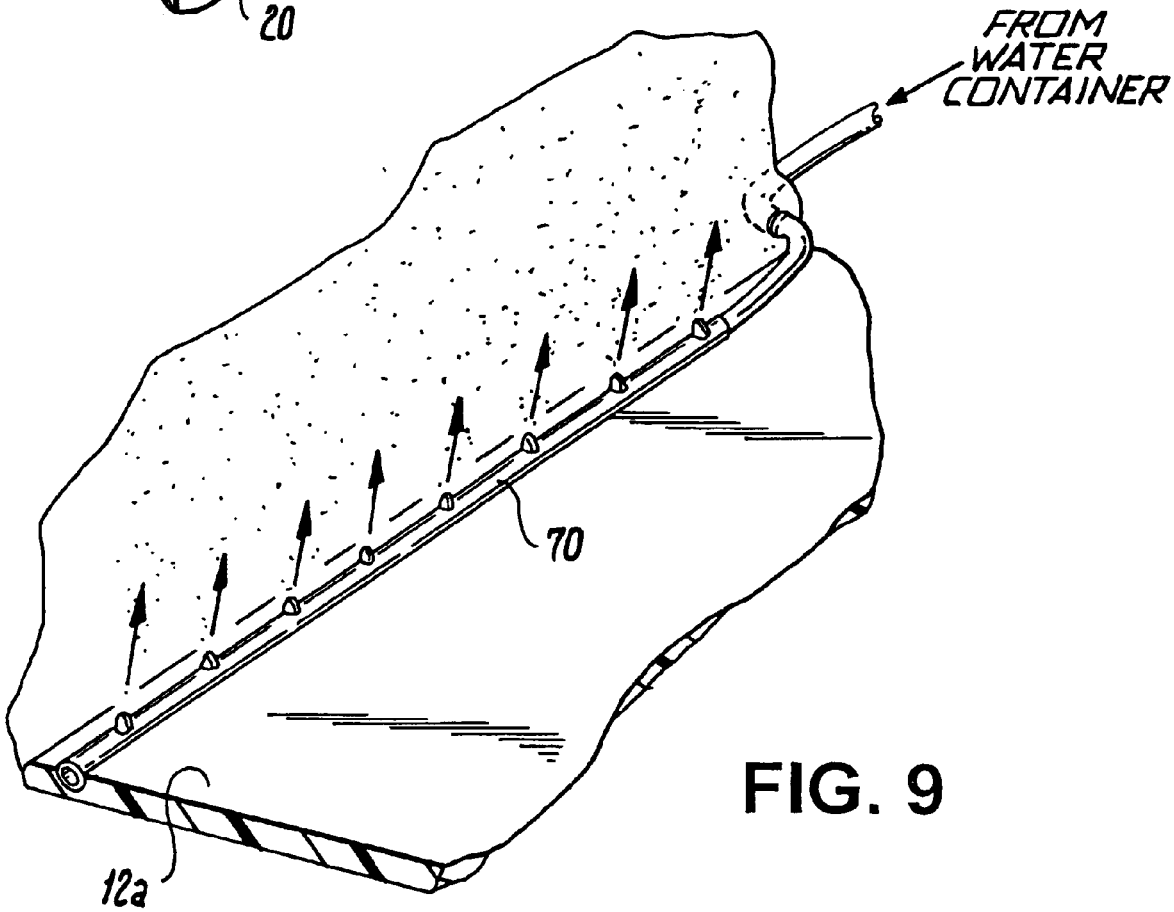
FIG. 9

EMERGENCY EVACUATION SYSTEM FOR A STAIRCASE

BACKGROUND OF THE INVENTION

1. Field of the Invention

The subject invention is directed to an emergency evacuation system, and more particularly, to a readily deployable emergency evacuation slide for use in a staircase of a multi-story building.

2. Background of the Related Art

During an emergency evacuation of a multi-story building, fire exits and stairways tend to become highly congested as large numbers of people attempt to flee the building and reach safety. This congestion tends to increase the evacuation time for the building and often inhibits access to the building by rescue workers.

Recent events, such as the terrorist attack on the World Trade Center, exemplify the need for an evacuation system that may be deployed in an existing stairway of a building, which reduces evacuation time by accommodating a rapid decent through the stairways of the building and enables easy access to the building by rescue workers and emergency personnel. Such an evacuation system should be compatible with existing building structures, and should not require extensive modifications to the building. Preferably, when inactive, such a system should not interfere with the normal, everyday function of the staircase and the building in general.

Also during an emergency evacuation of a multi-story building, disabled occupants including those in wheelchairs who are unable to traverse multiple flights of stairs, are often left without an adequate means of rapid escape from the building. It would be beneficial therefore, to provide a system that allows disabled and wheelchair bound people to rapidly evacuate a multi-story building. Such a system, should also allow emergency workers to rapidly evacuate injured occupants, including those who are stretcher bound.

SUMMARY OF THE INVENTION

The subject invention is directed to a new and useful system for easily and efficiently evacuating individuals from a multistory building during an emergency. The system is designed to decrease evacuation time, reduce exit and stairway congestion and promote easy access to the building by rescue workers. More particularly, the subject invention is directed to an emergency evacuation slide configured for deployment in a staircase having a flight of stairs which is compatible with existing building structures, does not require extensive modifications to the building, and, when inactive, does not interfere with the normal use of the staircase.

The evacuation slide of the subject invention is defined by an elongated base portion having an inner lateral edge configured for attachment to a sidewall of a staircase and an outer lateral edge extending into the staircase. The slide is adapted for movement from a stowed position in which the base portion is parallel to the side wall of the staircase, to a deployed position in which the base portion is perpendicular to the side wall of the staircase and disposed in a plane extending tangent to the horizontal treads of the stairs.

The emergency evacuation system of the subject invention further includes means for effectuating the movement of the evacuation slide from the stowed position to the deployed position. The means for effectuating the movement of the evacuation slide includes a latch system operatively associated with the sidewall of the staircase. The latch system is adapted for manual actuation or automated actuation. The means for effectuating the movement of the evacuation slide further includes biasing means for biasing the slide into the deployed position.

The emergency evacuation slide of the subject invention further includes a sidewall projecting from the outer lateral edge of the base portion and configured for deployment in a plane extending generally perpendicular to the base portion. The side wall of the slide is hinged to the outer lateral edge of the base portion, and biasing means are preferably provided for biasing the side wall of the slide into a deployed position. Preferably, the base portion of the evacuation slide is defined by a pair of elongated base members that are operatively connected to one another. In one embodiment of the invention, the base members are hinged to one another, and biasing means are provided for biasing the base members into a deployed position.

In accordance with an embodiment of the invention, an upper inflatable cushion is associated with an upper end portion of the base portion. The upper cushion preferably has an inclined surface that is aligned with the plane of the base portion for easing entry onto the slide. Preferably, the upper cushion is half the width of the base portion to further ease entry onto the slide. In accordance with an embodiment of the invention, a lower inflatable cushion is associated with a lower end portion of the base portion. The lower cushion preferably has an upper horizontal surface for easing departure from the slide. The slide also includes illuminating means that extend at least partially along the length of the base portion, and fluid dispensing means that extend at least partially along the length of the base portion for wetting the slide.

These and other unique features of the emergency evacuation system of the subject invention will become more readily apparent from the following description of the drawings taken in conjunction with the description of the preferred embodiment.

BRIEF DESCRIPTION OF THE DRAWINGS

So that those having ordinary skill in the art to which the subject invention pertains will more readily understand how to make and use the emergency evacuation system of the subject invention, embodiments thereof will be described in detail hereinbelow with reference to the drawings, wherein:

FIG. 8 is an enlarged localized perspective view of the illuminating device shown in FIG. 3 which extends along the upper edge of the upstanding side wall of the emergency evacuation slide of the subject invention; and FIG. 9 is an enlarged localized perspective view of the water dispensing device shown in FIG. 3 which extends along the lower inside edge of the base portion of the emergency evacuation slide of the subject invention.

DETAILED DESCRIPTION OF THE PREFERRED EMBODIMENTS

Figure 1:
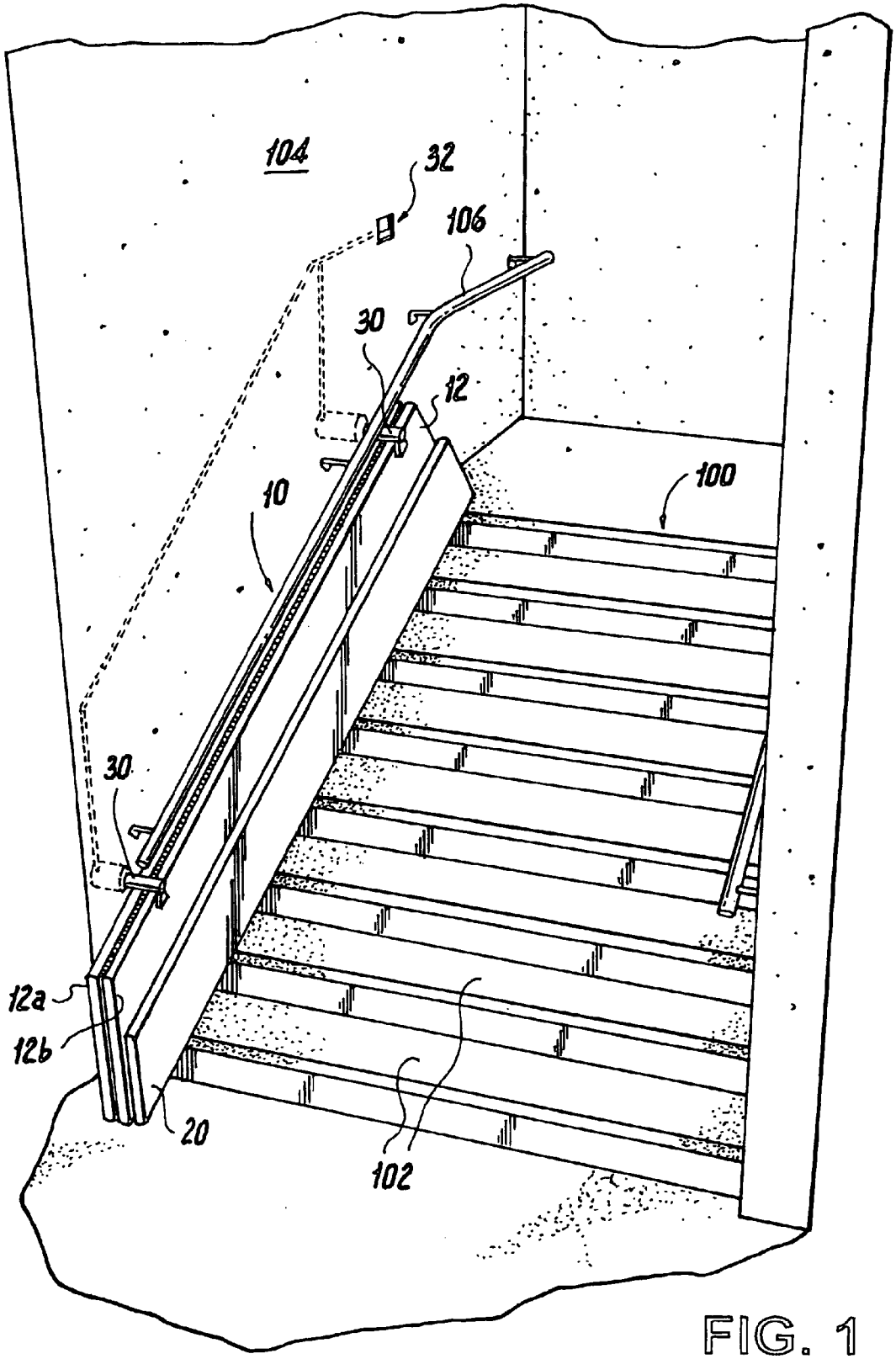
FIG. 1 is an illustration of a staircase in which the emergency evacuation slide of the subject invention is installed and shown in a stowed position.

Referring now to the drawings wherein like reference numerals identify similar aspects of the system of the subject invention, there is illustrated in FIG. 1 a deployable emergency evacuation slide for use in a staircase of a multistory building which is designated generally by reference numeral 10. In brief, slide 10 is adapted and configured for movement from a stowed position shown in FIG. 1 to a deployed position shown in FIG. 3, to facilitate the efficient emergency evacuation of a building while permitting access to the building via the staircase by firefighters and other emergency personnel. Preferably, the width of the slide is sufficient to enable a person to utilize the device, while allowing for and not inhibiting adequate access to the staircase. The slide is preferably stowed in a manner that does not interfere with the normal use of the staircase, such as below the handrail or the staircase or within a recess (not shown) formed into the sidewall of he staircase.

Figure 3:
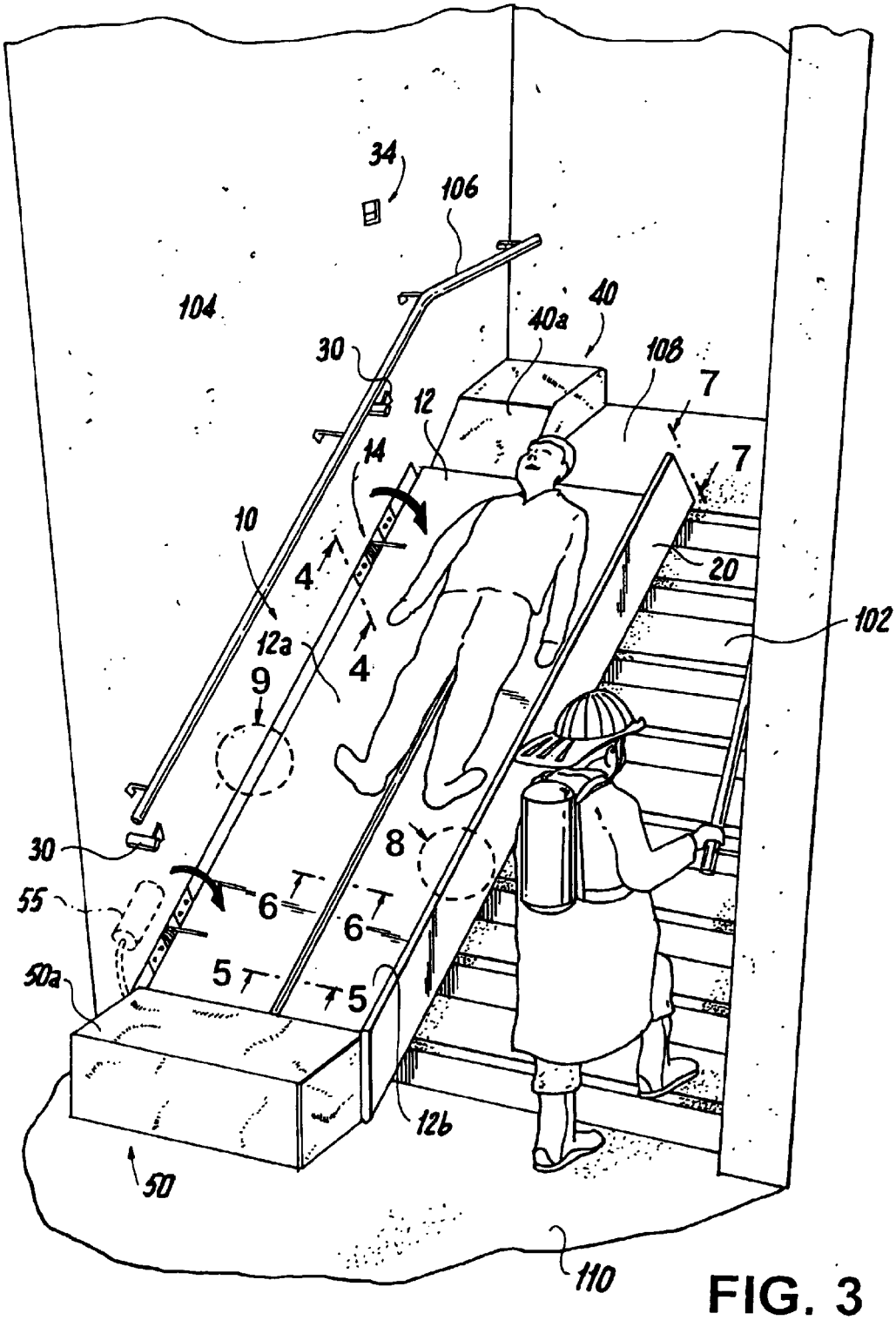
FIG. 3 illustrates the emergency evacuation slide of the subject in a deployed position, with cushions inflated at both ends of the slide.
Figure 4:
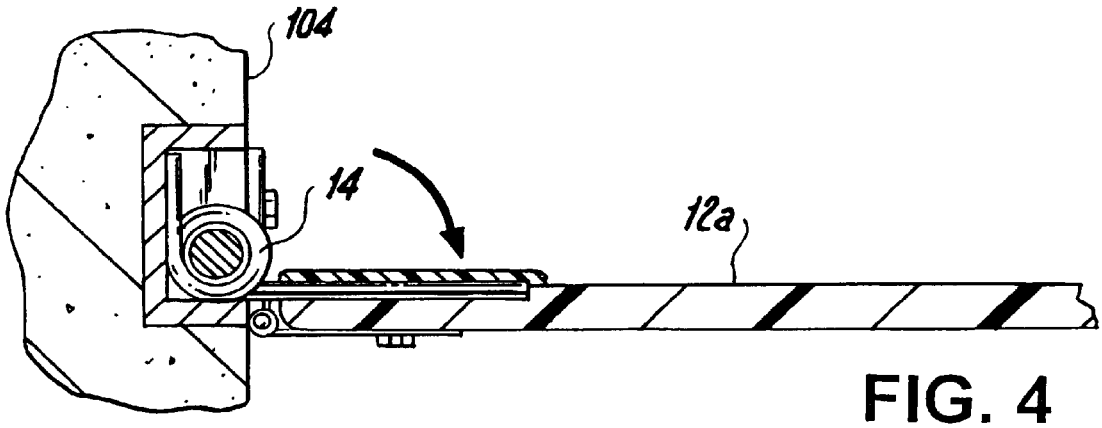
FIG. 4 is a cross-sectional view of the evacuation slide of the subject invention taken along line 4—4 of FIG. 3, illustrating the lateral deployment hinge associated with the sidewall of the staircase.

Referring to FIG. 3, emergency evacuation slide 10 includes an elongated base portion 12 configured for deployment over a flight of stairs 100 including a plurality of horizontal treads 102. The base portion 12 has an inner lateral edge configured for attachment to a sidewall 104 of the staircase 100 and an outer lateral edge that extends partially into the staircase. As shown for example in FIG. 4, the base portion 12 is operatively connected to the sidewall 104 of the staircase by one or more spring biased hinges 14.

Figure 5:
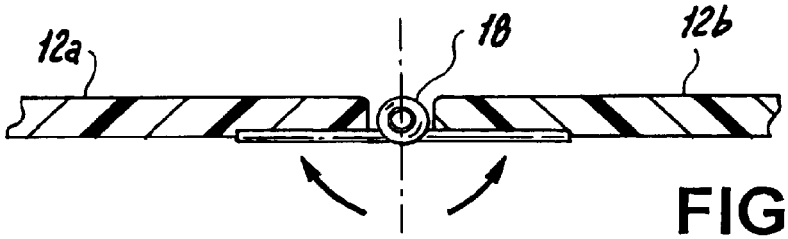
FIG. 5 is a cross-sectional view of the evacuation slide of the subject invention taken along line 5—5 of FIG. 3, illustrating the central deployment spring associated with the base portion of the slide.
Figure 6:
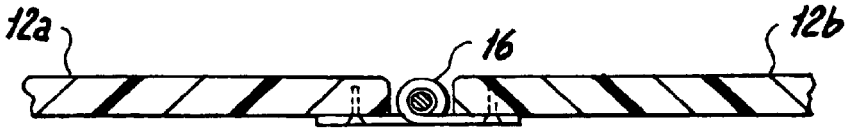
FIG. 6 is a cross-sectional view of the evacuation slide of the subject invention taken along line 6—6 of FIG. 3, illustrating the central hinge associated with the base portion of the slide.

To conserve space in the stowed position below handrail 106, base portion 12 is defined by a pair of elongated, folded base members 12*a*, 12*b*. The base members 12*a*, 12*b* are operatively connected to one another such as by hinges 16 or similar connective devices, as shown in FIG. 6. Preferably, as shown in FIG. 5, one or more biasing springs 18 connect the base members 12*a*, 12*b* to one another and bias the base members into a deployed, planar position. It is envisioned that the base portion 12 of slide 10 could be divided into three or more longitudinally connected, folding base members to further reduce the size of the apparatus, or to accommodate certain existing building structures.

Figure 7:
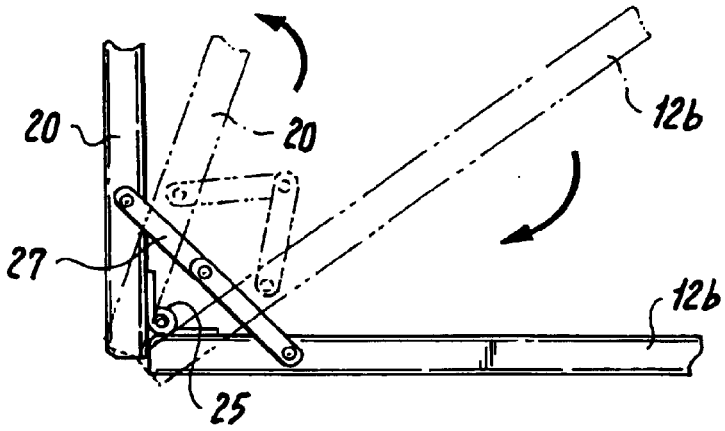
FIG. 7 is an end view taken along line 7—7 of FIG. 3 illustrating the deployment spring and support linkage operatively associated with the upstanding sidewall of the slide.

With continuing reference to FIG. 3, slide 10 further includes an upstanding sidewall 20 that projects from the outer lateral edge of base portion 12. Sidewall 20 is adapted and configured for deployment in a plane that extends generally perpendicular to the plane of base portion 12. Sidewall 20 is operatively hinged to the outer lateral edge of base portion 12. Preferably, as shown in FIG. 7, one or more biasing springs 25 connect the sidewall 20 to base portion 12 for biasing the sidewall into a deployed position. In addition, as shown in FIG. 7, a two-bar support linkage 27 is provided to maintain the sidewall in an upstanding position once deployed. Alternative support mechanism may be employed in lieu of the linkage, such as a brace or strut.

The base members 12*a*, 12*b* and sidewall 20 of evacuation slide 10 are preferably constructed from a lightweight, high-strength composite material, such as, for example, fiberglass or a similar structural material. These structural components may be relatively thin. For example, the base members 12*a*, 12*b* and sidewall 20 of the slide 10 may be between ¼" to ½" thick depending upon the materials of construction.

Figure 2:
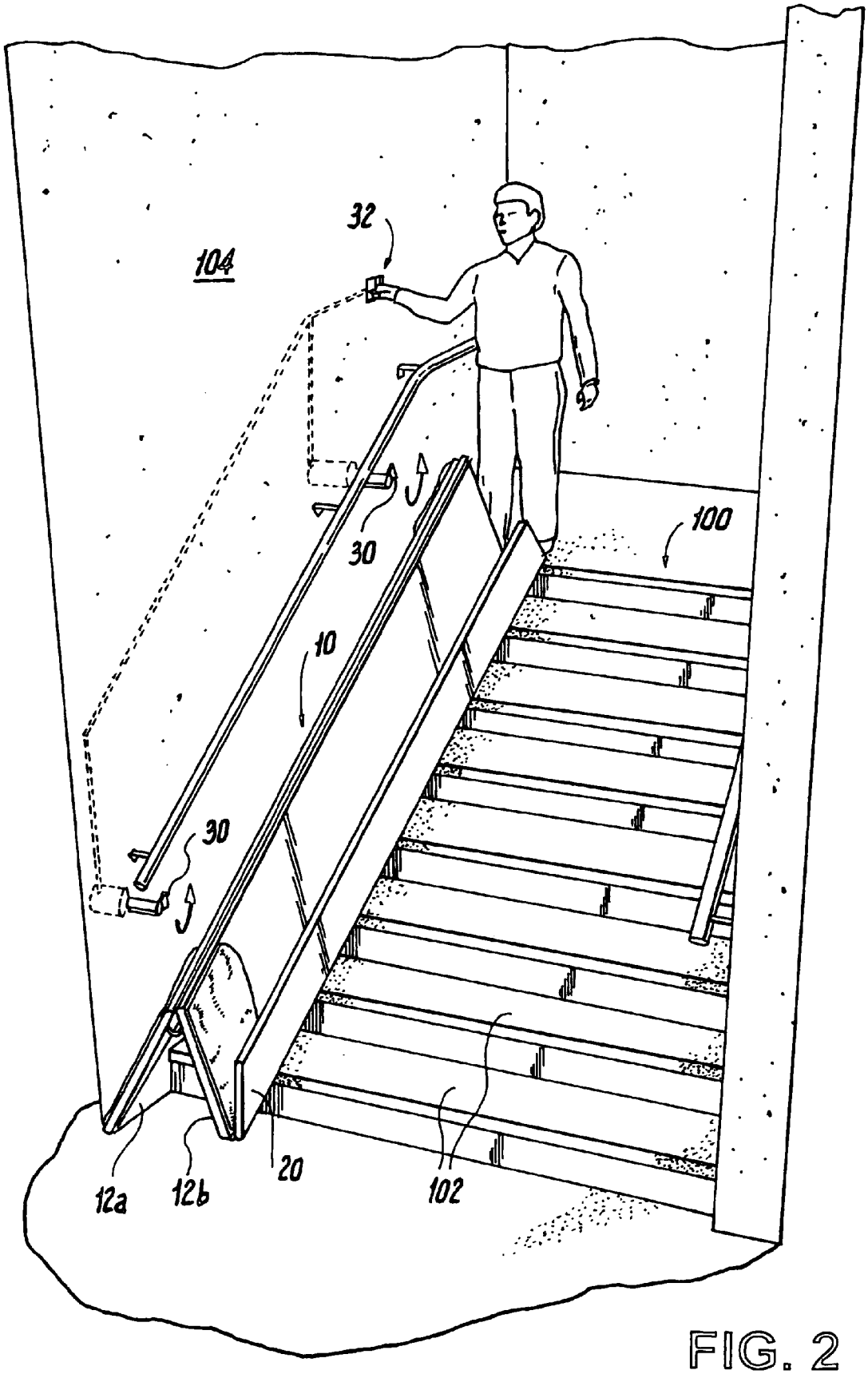
FIG. 2 illustrates the deployment of the evacuation slide of the subject from the stowed position of FIG. 1.

Referring to FIG. 2, the emergency evacuation system of the subject invention includes one or more features for effectuating the movement of slide 10 from the stowed position of FIG. 1 to the deployed position of FIG. 3. This includes a latch system or similar mechanism operatively associated with the sidewall of the staircase. The latch system includes one or more latches 30 that easily are movable from a first position in which the slide 10 is secured and maintained in its stowed position, to a second position in which the slide 10 is permitted to move to its deployed position under the influence of gravity, assisted by the various biasing springs associated with the structure.

The latch system for deploying slide 10 can be adapted for manual or automated actuation. In the case of a manually actuated system, the latches would be selectively activated by a switching mechanism 32 on the sidewall 104 adjacent the top of staircase 100. In the case of an automated system, the latches could be activated by a signal emanating from a remote control unit which is programmed to deploy the evacuation slide 10 during an emergency situation.

As best seen in FIG. 3, slide 10 includes an inflatable upper cushion 40 that is operatively associated with an upper end portion of base portion 12. Upper cushion 40 has an inclined surface 40*a* that is preferably aligned with the plane of base portion 12 and is deployed on the upper landing 108 of staircase 100 to ease access to slide 10. To this end, the width of upper cushion 40 is less than the width of base portion 12. For example, the upper cushion 40 may be half the width of base portion 12. Slide 10 further includes an inflatable lower cushion 50 that is operatively associated with a lower end portion of base portion 12. Lower cushion 50 includes an upper horizontal surface 50*a* and is deployed on the lower landing 110 of staircase 100 to ease one's exit from the slide during use.

The evacuation system of the subject invention further includes a source of compressed gas for inflating the upper and lower cushions 40, 50. Preferably, the source of compressed gas is located adjacent to the slide, such as, for example, the canister 55 which is located in a compartment or recess behind or within the sidewall 104 of staircase 100, as shown in FIG. 3. It is envisioned that inflation of the upper and lower cushions 40, 50 can occur automatically by remote control or manually upon selective deployment of slide 10.

In an embodiment of the invention, evacuation slide 10 also includes illuminators 60 that extend at least partially along the length of the slide, as shown in FIG. 8. Preferably, the illuminators are located along the upper edge of sidewall 20. However, they can be located in any convenient, visible location along the length of the slide. The lights can be small electrically powered bulbs, or they can consist of chemically reactive lighting devices. It is envisioned that illuminating system 60 could be activated automatically from a remote control or manually upon deployment of slide 10.

In an embodiment of the invention, evacuation slide 10 further includes a fluid dispensing system 70 that extends at least partially along the length of the slide for wetting the slide, as shown in FIG. 9. This will tend to keep the upper surface of the slide cool and lubricated during use. In this instance, the fluid dispensing system 70 would consist of a flexible tube with a plurality of apertures which is connected to a local or remote water supply. It is envisioned that the fluid dispensing system 70 could be activated automatically from a remote location or manually upon deployment of slide 10.

In use, through actuation of the latches 30, as shown for example in FIG. 2, the evacuation slide 10 is moved from the stowed position of FIG. 1 wherein both members 12*a*, 12*b* of the base portion 12 and the sidewall 20 are parallel to the sidewall 104 of staircase 100, to the deployed position of FIG. 3 under the influence of gravity, assisted by the various biasing springs associated with the slide. In the deployed position, both base members 12*a*, 12*b* of base portion 12 are perpendicular to the sidewall 104 of staircase 100 and are disposed in a plane extending tangent to the treads 102 of the stairs, and the sidewall 20 of the slide 10 projects upwardly from the base portion 12. Once the slide is deployed, cushions 40, 50 are inflated, either automatically or manually. In addition, the illuminators 60 and fluid dispensing system 70 are activated, either automatically or manually. At such a time, a person may utilize evacuation slide 10 to rapidly descend the staircase without impeding the ascent of emergency personnel, as illustrated in FIG. 3. Furthermore, disabled, injured or wheelchair bound people can utilize the slide to rapidly descend the staircase.

Although the system of the subject invention have been described with respect to preferred embodiments, those skilled in the art will readily appreciate that changes and modifications may be made thereto without departing from the spirit and scope of the subject invention as defined by the appended claims.

What is claimed is:

1. An emergency evacuation slide comprising:

an elongated base portion configured for deployment in a staircase having a flight of stairs including a plurality of horizontal treads, the base portion having an inner lateral edge having means for attachment to a side wall of the staircase, a pair of elongated base members having upper and lower surfaces and a set of adjacent edges operatively connected to one another for pivotal movement, and an outer lateral edge adapted to extend into the staircase, the evacuation slide being moved into a stowed position in which the base portion is vertical and adapted to be parallel to the side wall of the staircase and the lower surfaces of the pair of elongated base members are adjacent to one another and to a deployed position in which the base portion is adapted to be perpendicular to the side wall of the staircase and disposed in a plane extending tangent to the treads of the stairs with the upper surfaces of the pair of elongated base members being in a coplanar relationship with respect to one another, a side wall hinged to said outer lateral edge and having means for maintaining said side wall perpendicular to said upper surfaces in said deployed position.

2. An emergency evacuation slide as recited in claim 1, wherein said means for attachment comprises a hinge for attachment to the sidewall of the staircase.

3. An emergency evacuation slide as recited in claim 1, further comprising means for effectuating the movement of the evacuation slide from the stowed position to the deployed position.

4. An emergency evacuation slide as recited in claim 3, wherein the means for effectuating the movement of the evacuation slide from the stowed position to the deployed position includes a latch system operatively associated with the side wall of the staircase.

5. An emergency evacuation slide as recited in claim 4, wherein latch system is adapted for manual actuation.

6. An emergency evacuation slide as recited in claim 4, wherein latch system is adapted for automated actuation.

7. An emergency evacuation slide as recited in claim 3, wherein the means for effectuating the movement of the evacuation slide from the stowed position to the deployed position includes biasing means for biasing the slide into the deployed position.

8. An emergency evacuation slide as recited in claim 1, further comprising illuminating means extending at least partially along the length of the slide for illuminating the slide, the illuminating means associated with a source of power.

9. An emergency evacuation slide as recited in claim 1, further comprising fluid dispensing means extending at least partially along the length of the slide for wetting the slide, the fluid dispensing means associated with a source of water.

10. An emergency evacuation slide as recited in claim 1, further comprising biasing means for biasing the sidewall of the slide into said deployed position.

11. An emergency evacuation slide as recited in claim 1, wherein the pair of elongated base members are operatively connected to one another along a set of adjacent longitudinal edges.

12. An emergency evacuation slide as recited in claim 11, wherein the set of adjacent longitudinal edges are hinged to one another.

13. An emergency evacuation slides as recited in claim 12, further comprising biasing means for biasing the base members into said deployed position.

14. An emergency evacuation slide as recited in claim 1, further comprising an inflatable cushion associated with an upper end portion of the base portion and having an inclined surface aligned with the plane of the base portion.

15. An emergency evacuation slide as recited in claim 1, further comprising an inflatable cushion associated with a lower end portion of the base portion and having an upper horizontal surface.

16. An emergency evacuation slide as recited in claim 1, further comprising a source of compressed gas for inflating a cushion associated with the base portion.

17. An emergency evacuation slide as recited in claim 1, further comprising illuminating means extending at least partially along the length of the slide for illuminating the slide.

18. An emergency evacuation slide as recited in claim 17, further comprising means for supplying power to the illuminating means.

19. An emergency evacuation slide as recited in claim 1, further comprising fluid dispensing means extending at least partially along the length of the slide for wetting the slide.

20. An emergency evacuation slide as recited in claim 19, further comprising means for supplying water to the fluid dispensing means.

21. An emergency evacuation slide comprising:

a) an elongated base portion configured for deployment in a staircase having a flight of stairs including a plurality of horizontal treads, the base portion having an inner lateral edge hinged to a side wall of the staircase, a pair of elongated base members having upper and lower surfaces and a set of adjacent edges operatively connected to one another for pivotal movement, and an outer lateral edge extending into the staircase; and b) means for moving the evacuation slide from a stowed position in which the base portion is parallel to the side wall of the staircase and the lower surfaces of the pair of elongated base members are adjacent to one another to a deployed position in which the base portion is perpendicular to the side wall of the staircase and disposed in a plane extending tangent to the treads of the stairs with the upper surfaces of the pair of elongated base members being in a coplanar relationship with respect to one another, a side wall hinged to said outer lateral edge and having means for maintaining said side wall perpendicular to said upper surfaces in said deployed position.

22. An emergency evacuation slide as recited in claim 21, wherein the means for effectuating the movement of the evacuation slide from the stowed position to the deployed position includes a latch system operatively associated with the side wall of the staircase.

23. An emergency evacuation slide as recited in claim 21, wherein the means for effectuating the movement of the evacuation slide from the stowed position to the deployed position includes biasing means for biasing the base portion into the deployed position.

24. An emergency evacuation slide as recited in claim 21, further comprising biasing means for biasing the base members into said deployed position.

25. An emergency evacuation slide as recited in claim 21, wherein set of adjacent edges are hinged to one another.

26. An emergency evacuation slide as recited in claim 25, further comprising biasing means for biasing the base members into said deployed position.

27. An emergency evacuation slide as recited in claim 21, further comprising an inflatable cushion associated with an upper end portion of the base portion and having an inclined surface aligned with the plane of the base portion, the inflatable cushion associated with a source of compressed gas.

28. An emergency evacuation slide as recited in claim 21, further comprising an inflatable cushion associated with a lower end portion of the base portion and having an upper horizontal surface, the inflatable cushion associated with a source of compressed gas.

* * * * *